US006098201A

United States Patent [19]

Boros, Sr.

[11] Patent Number: 6,098,201

[45] Date of Patent: Aug. 8, 2000

[54] MOLDABLE FACE-MASK

[75] Inventor: Henry R. Boros, Sr., Hernando, Fla.

[73] Assignee: Richard T. Weisenburger, Crystal River, Fla.

[21] Appl. No.: 09/275,181

[22] Filed: Mar. 24, 1999

[51] Int. Cl.[7] ..... A41D 13/00; A61F 9/00

[52] U.S. Cl. ..... 2/206; 2/9

[58] Field of Search ..... 2/206, 209, 173, 2/9, 417, 424, 425, 4; 128/206.12, 206.16, 206.17, 206.19, 206.28, 857

[56] References Cited

U.S. PATENT DOCUMENTS

| | | | |
|---|---|---|---|
| 1,087,418 | 2/1914 | Zucker | 2/4 |
| 2,189,892 | 2/1940 | Fox | 2/4 |
| 3,310,709 | 3/1967 | Phillips | 2/9 |
| 3,789,839 | 2/1974 | Lund et al. | 2/206 |
| 4,685,152 | 8/1987 | Heare | 2/4 |
| 4,831,665 | 5/1989 | Palmaer | 2/9 |
| 5,072,460 | 12/1991 | Weder | 2/206 |
| 5,099,525 | 3/1992 | Millauro | 2/206 |
| 5,357,635 | 10/1994 | Lemoine | 2/424 |

*Primary Examiner*—Amy B. Vanatta
*Attorney, Agent, or Firm*—Martin Fleit

[57] ABSTRACT

A face-mask which is made of a plastic sheet in which is embedded a deformable skin-colored, plastic-coated wire mesh. The plastic sheet is moldable and has an octagonal shape that will fit over the face of a wearer to cover the wearer's nose and mouth with tabs to fit under the chin. A trapezoidal opening is formed in the plastic sheet at a location that will overlie the nose and mouth of the wearer. A fastener system, located at the perimeter of the opening, surrounds the opening to fasten detachably a filter element in a position that covers the opening. The filter element is in sheet form having a shape complementary to the shape of the opening. Elastic cords hold the face-mask on the head of the wearer.

11 Claims, 2 Drawing Sheets

MOLDABLE FACE-MASK

FIELD OF THE INVENTION

The present invention relates to a novel face-mask that can be molded to the face of a wearer.

BACKGROUND OF THE INVENTION

Many different types and styles of face-masks have been advanced, and each in its own fashion is suitable for a particular purpose. The faces of people vary greatly with respect facial features regarding size, arrangement, facial contours, etc. which makes it difficult for people to fit a pre-molded mask. Consequently, a need still exists for an inexpensive face-mask that can be used for long periods of time and will fit the special facial features of the individual wearer.

SUMMARY OF THE INVENTION

It is the principal object of the present invention to provide a face-mask that can be molded to the special facial features of the face of an individual wearer, and which will have the ability to be used with replaceable filters.

Further, it is an object of the present invention to provide a novel face mask that can come in different sizes and can readily be molded to the special facial features of the face of an individual wearer, and thereby not ride on the face. A still further object of the present invention is to provide a face-mask which can be reused by easy replacement of an inexpensive filter element of the face-mask which can be readily cleaned, which will not hide the wearer's appearance, which will blend into the face of the wearer and which has a streamlined look.

The foregoing objects of the present invention are achieved by the provision of a unique face-mask structure that enables the mask to be molded by a wearer to the special facial features of an individual wearer, and thereafter, will retain the molded shape. This is generally accomplished by a mask structure that consists of a metal screen or mesh that is embedded in a biologically safe plastic material. The structure of the mask includes an opening, generally overlaying the nasal region and the mouth. A filter element, of a color to match skin color, is detachably mounted to the mask structure to enclose the opening. The skin-colored filter element is composed of fibrous material, and the filter is detachably retained on the main face mask structure in a manner, such as, using a pull tab, so that it can be removed and replaced easily. Also, the face-mask structure includes a soft resilient bead, such as, foamed plastic, which surrounds the perimeter of the mask on the side in contact with the face of the wearer, so that the mask can be worn comfortably and can maintain a better seal with the face of the wearer. Other and further objects of the present invention will become readily apparent from the following detailed description of a preferred embodiment of the invention when taken in conjunction with the appended drawings.

DETAILED DESCRIPTION OF PREFERRED EMBODIMENT

Figure 1:
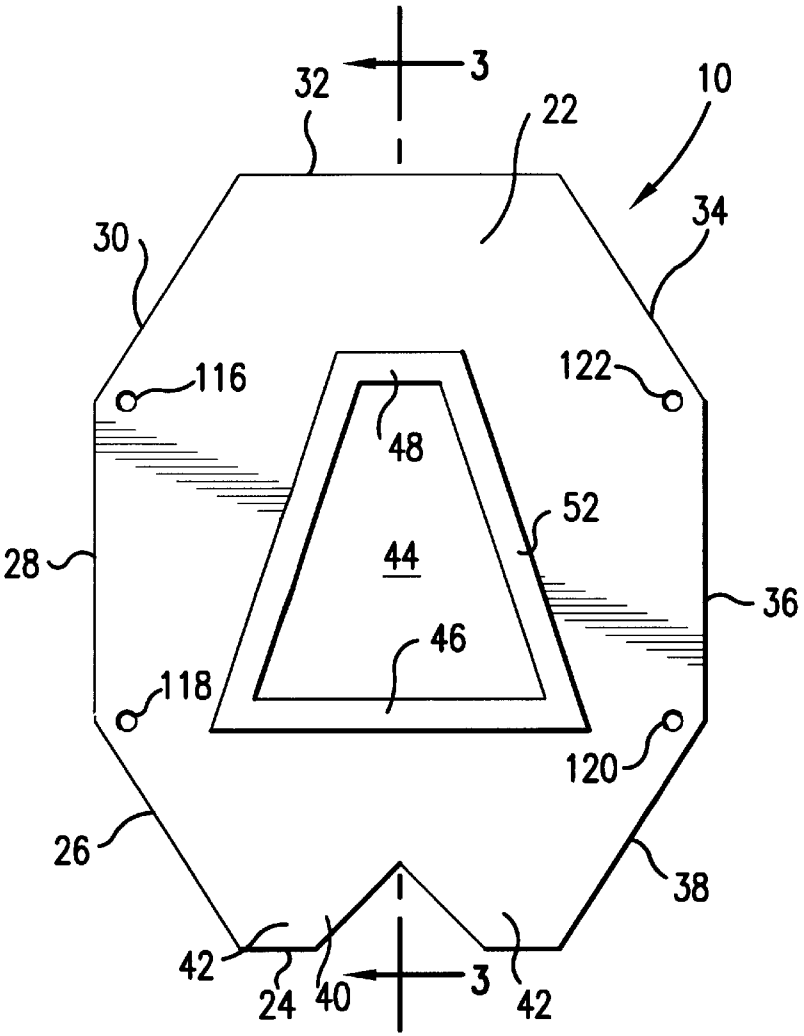
FIG. 1 is a top plan view of the mask.
Figure 2:
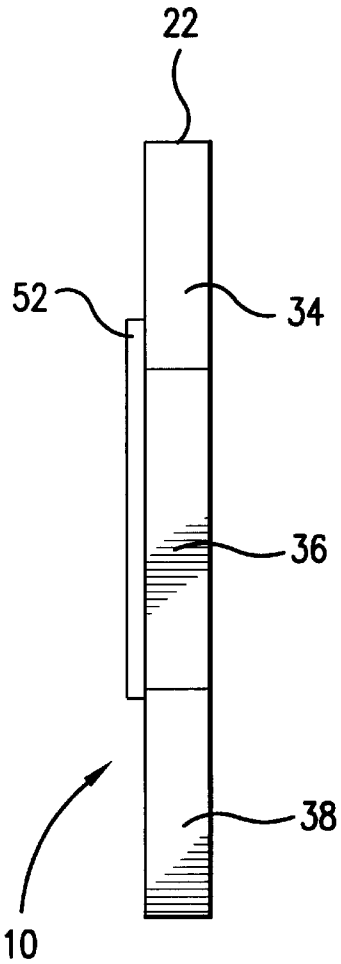
FIG. 2 is a side view of the mask shown in FIG. 1.
Figure 3:
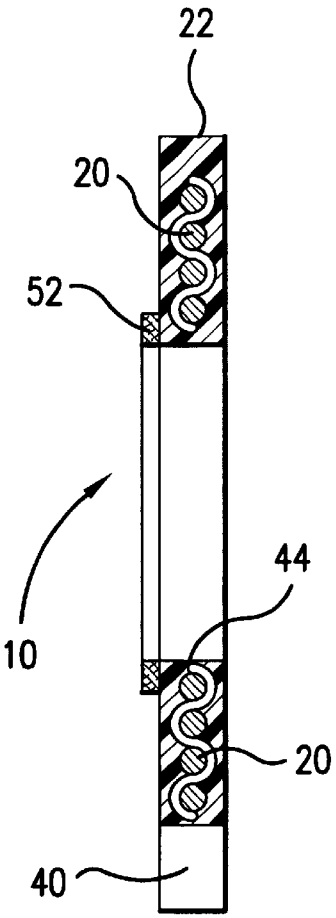
FIG. 3 is a sectional view of the mask taken along line 3—3 of FIG. 1.

Referring now to the drawings, and in particular to FIGS. 1 to 3 and 7, a preferred embodiment is now described. The novel mask 10 consists of a skin-colored, plastic-coated metal mesh 20 that is embedded in a plastic sheet or laminae 22. The mesh 20 is preferably stainless steel but may be aluminum or any other suitable material. Mesh 20 is comprised of about a ⅛ inch woven mesh coated with a skin-colored suitable plastic, such as, polyvinyl. The mesh 20 is flexible, bendable and moldable, and will retain whatever shape it is bent or molded into. Accordingly, mesh 20 is capable of being fitted closely to the face and head of the wearer. The plastic sheet 22 into which the mesh 20 is embedded may be any suitable plastic material that is bio-compatible, transparent and can be deformed into and will hold a shape by the molding of the mesh. Clear polyvinyl plastic would be a suitable material by way of example, but not limitation.

The plastic sheet 22 with mesh 20 embedded is preferably of substantially octagonal shape with from about 1.5 to about 2 inch length sides 24 to 38. The shape may be circular or some other regular or irregular shape that will overlie the face of the wearer and fit under the chin, but octagonal is preferred. Side 24 has a V-shaped cutout at 40 to form a pair of tabs 42 about ⅜ inch in length at their outside edges to be bent or deformed to fit under the chin of the wearer.

A central opening 44 in the shape of a trapezoid is provided at the central region of the sheet 22. The large or major base 46 of the central trapezoidal opening 44 lies adjacent the V-shaped cutout 40 and side 24, with the small or minor base 48 of the trapezoidal opening 44 lying remote from the V-shaped cutout 40 and adjacent side 32. Major base 46 is about 1½ to 2 inches in length, and minor base 48 is about ½ inch in length. The distance between the bases 46 and 48 is from about 1½ to about 2 inches in length depending on the sizing of the mask. Essentially, it is contemplated that three sizes, e.g. small, medium and large, should be sufficient, but a greater or lesser number of sizes may be made available.

Figure 4:
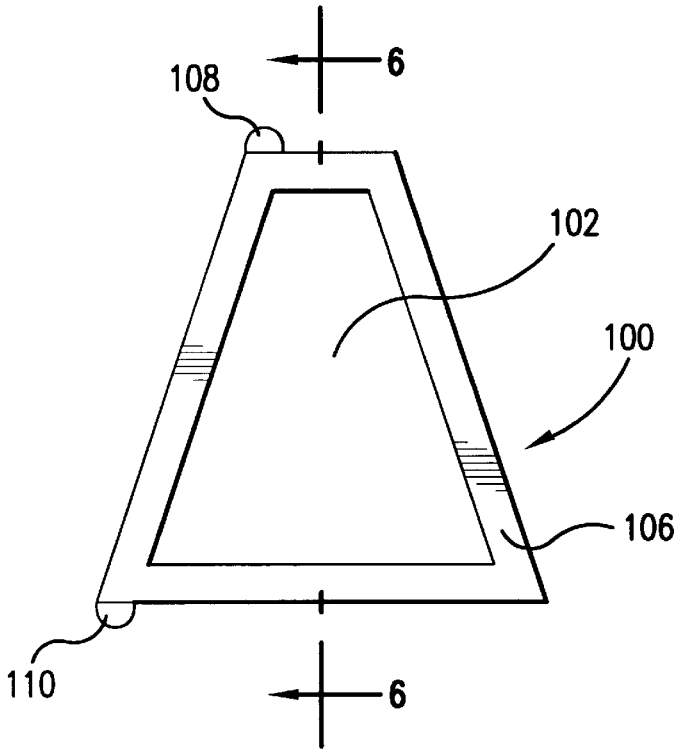
FIG. 4 is a top plan view of the filter element used with the mask of FIG. 1.
Figure 5:
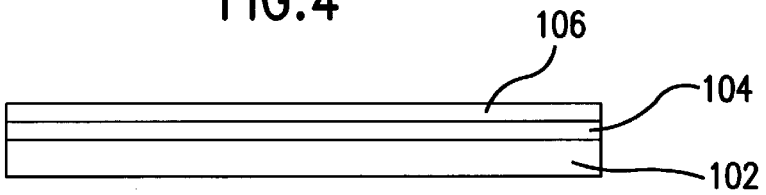
FIG. 5 is a side view of the filter element of FIG. 4.
Figure 6:
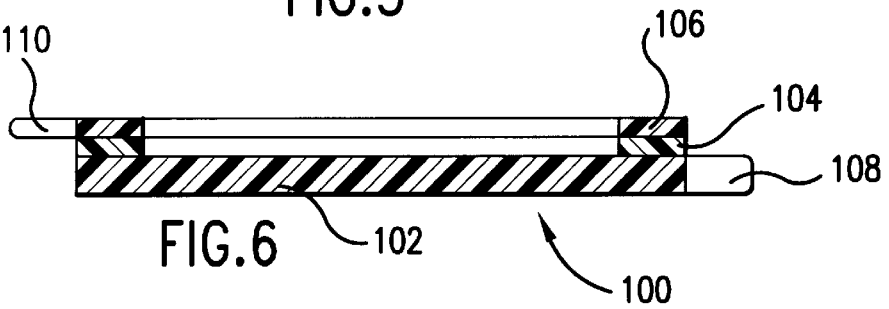
FIG. 6 is a sectional view of the filter element taken along line 6—6 of FIG. 4.

Surrounding the central opening 44 is a perimeter border 50 that is about ¼ inch wide. Attached to the face-mask sheet 22 around the perimeter of opening 44 is a ¼ inch strip 52 composed of a material to which a filter element 100, as shown in FIGS. 4–6, can be securely attached, yet readily removed. Strip 52 may be comprised of, for example, a glassine paper to which certain types of adhesive can secure in a detachable way. Any suitable material may be used for the strip 52 that has the property of allowing an adhesive to secure to the strip in an easily detachable way. Since such materials are well know in the art to those of ordinary skill, no attempt will be made to elaborate further. Strip 52 can be made of a material to which a disposable fibrous filter element 100 can be secured directly, provided the filter element 100 can also be easily detached to allow a further replacement, disposable filter element 100 to be attached.

Figure 8:
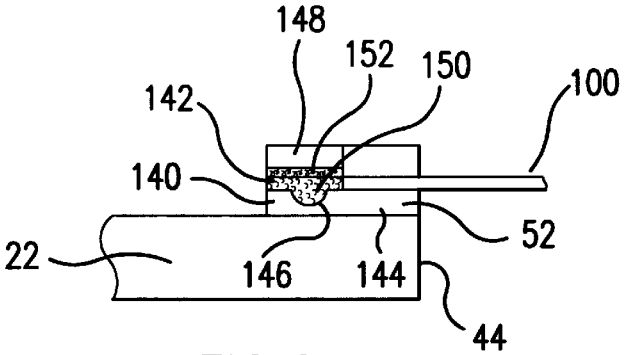
FIG. 8 is a partial view showing a mechanical system for detachably fastening the filter.

Alternatively, as shown in FIG. 8, it is possible to use a mechanical system for mounting a disposable filter element.

Such a system would use, for example, a strip 52 the outer portion 140 of which has a one half 142 of a Velcro hook and loop fastener, and the inner portion 144 of which adjacent the opening 44 is a smooth surface. A groove 146 is defined between the two portions. A simple planar disposable fibrous filter element 100, in sheet form, is overlaid the opening 44 and the strip 52 with its edges overlying and registering with the groove 146. A closure element 148, in the configuration of the strip 52, with a depending projection tongue or rib 150 that is received in the groove 146, overlies the strip 52. The complementary half 152 of the velcro hook and loop fastener is secured to the closure element 148 on it downwardly facing side to cooperate with the part of the Velcro fastener on the strip 52, and the depending rib 150 fits into the groove 146 trapping the disposable fibrous filter element 100 therebetween, to hold the filter element 100 in a detachable position. Upon removal of the closure element 148, including removal of the rib 150 from the groove 146, the filter element 100 can easily be taken off and replaced. In this system, no adhesive is required.

The filter element 100 is shown in FIGS. 4–6 and consists of a sheet of fibrous material 102 in the shape of the opening 44 and strip 52, that is, trapezoidal, and is cut to register with the outer perimeter of the strip 52, without interfering with the Velcro fastener, if that is the mounting system being used. Coated on the perimeter of sheet 102 to a width of about ¼ inch to match the strip 52, is an annular or peripheral coating 104 of a suitable adhesive that enables attachment to the strip 52, but in an easily detachable way. The types of adhesive that are suitable for this purpose are well known to those skilled in the art, and no further elaboration is required. The point is that the strip 52 and the coating 104 are selected to enable the filter element 100 to be appropriately secured to the mask, but in an easily detachable way so that when the filter element is used-up or exhausted and needs replacement, it can be readily replaced simply and easily. Overlying the coating 104 is a protective strip 106 which is of a material that lightly secures to the coating 104, but at the same time can be very easily removed from the coating 104 when the filter element is to be mounted and secured to the mask as described. Again, such materials are well known to those skilled in the art and no further elaboration is required.

As shown in FIG. 4, a tab 108 projects from the sheet 102 from one comer of the small base in order to facilitate removal and replacement of the filter element. Tab 108 does not contain the coating 102 nor the protective strip 106. Similarly, a tab 110 projects from the protective strip 106 to facilitate its removal in preparation for mounting a filter element 100 onto the mask.

Figure 7:
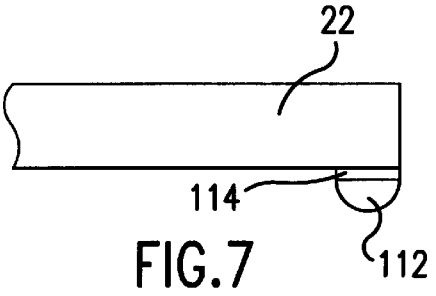
FIG. 7 is a partial side view of the mask of FIG. 1 showing the soft resilient bead to seal the mask against the face of the wearer.

As shown in FIG. 7, a soft bead 112 of a resilient material, such as, foamed polyurethane or silicone, surrounds the mask about its perimeter, in order to form a tight seal or to enhance a tighter seal with the face of the wearer. Bead 112 can be bonded directly to plastic sheet 22 or bonded indirectly by means of an adhesive 114, as desired. As shown in FIG. 1, through-holes 116, 118, 120 and 122 are formed in the mask at four locations about ¼ inch from the edge or perimeter of the mask. One hole 116 is located at the junction of sides 28 and 30, hole 118 is located at the junction of sides 26 and 28, hole 120 is located at the junction of sides 36 and 38, and the fourth hole 122 is located at the junction of sides 34 and 36. These locations correspond generally to the eye level of the wearer's face and the mouth level of the wearer's face. Grommets or other reinforcement are fitted into the holes 116–122.

Elastic cords (not shown), approximately ⅛ inch diameter, preferably colored a skin tone, are detachably secured in the holes 116 to 122, with one cord secured in holes 116 and 122 and the other cord secured in holes 118 and 120. In this manner the mask can be mounted to the head of a wearer with the cords passing behind the head and generating sufficient tension due to stretching to hold the mask in place without riding up or down on the wearer's face.

The mask is used in the following manner. First, a filter element 100 is inserted into or on the plastic sheet 22 around the opening 44 using either the adhesive technique described above or the mechanical technique described above. Next, the mask is fitted to the face of the wearer by deforming the portion of the mask that goes over the bridge of the nose of the wearer by appropriately bending this portion while applying the mask directly to the face of the wearer. The surrounding perimeter edge of the mask is deformed to fit the face of the wearer by molding the mask directly on the face to fit over the cheek areas closely. The tabs at the bottom are bent under the chin of the wearer to hold the mask snugly at this point. In this activity, the resilient bead 112 is compressed slightly to insure a close fit against the face and chin of the wearer. The elastic straps or cords are then passed around the wearer's head to hold the molded mask in a snug fit. In this fashion, the mask provides a tailor-made fit to the wearer's face and head with the filter element appropriately positioned over the nose and mouth of the wearer. When the filter element is exhausted, the mask is removed from the head of the wearer, and the filter element is changed, as described in the foregoing, and the mask repositioned on the wearer's head. If the mask becomes dirty or needs cleaning, it is removed, the filter element removed, the mask washed and the filter element replaced as previously described.

Although the invention has been described in terms of a preferred embodiment, nevertheless, changes and modifications can be made which do not depart from the spirit, scope and teachings of the invention. Such changes and modifications are deemed to fall within the purview of the present invention as claimed.

What is claimed is:

1. A face-mask comprising a body member composed of a plastic sheet in which is embedded a deformable wire mesh, said body member having a shape that will fit over the face of a wearer to cover the wearer's nose and mouth and fit under the chin; an opening defined in the body member at a location that will overlie the nose and mouth of the wearer; a fastener system located at the perimeter of the opening and extending peripherally to surround the opening adapted to fasten detachably a filter element in a position that covers the opening with the filter element sealed,to the body member about its perimeter; and a filter element in sheet form having a shape complementary to the shape of the opening defined in the body member.

2. A face-mask according to claim 1 wherein the wire mesh is plastic coated.

3. A face-mask according to claim 1 wherein the body member is octagonal.

4. A face-mask according to claim 1 further including elastic cords attached to said body member to enable the face-mask to be held on the head of the wearer.

5. A face-mask according to claim 1 wherein the body member defines at least one tab to fit under the chin of the wearer and to assist in holding the face-mask on the head of the wearer.

6. A face-mask according to claim 1 wherein the opening and the filter element are trapezoidal in shape.

7. A face-mask according to claim 1 wherein the fastener system comprises an adhesive coated on the filter element, and a surface formed on the body member surrounding the opening therein which can bond with the adhesive in a way to enable easy detachment and replacement of the filter element.

8. A face-mask according to claim 1 wherein the fastener system comprises an anchor hook and loop strip fixed to the body member and surrounding the opening, a closure hook and loop strip to mate with said anchor hook and loop strip, and said strips mutually defining cooperating parts to trap a filter element between said hook and loop strips.

9. A face-mask according to claim 8 wherein the mutually defining parts are a tongue and groove.

10. A face-mask according to claim 1 wherein a resilient bead is fixed to the edge of the body member to be compressed slightly when the face-mask is placed on the face of a wearer.

11. A face-mask according to claim 2 wherein the sheet is transparent and the plastic coat on the wire mesh is skin-colored.

* * * * *